US010323219B2

(12) United States Patent
Lant et al.

(10) Patent No.: US 10,323,219 B2
(45) Date of Patent: Jun. 18, 2019

(54) PROCESS FOR REBLENDING A FIRST LIQUID DETERGENT COMPOSITION INTO A SECOND LIQUID DETERGENT COMPOSITION

(71) Applicant: The Procter & Gamble Company, Cincinnati, OH (US)

(72) Inventors: Neil Joseph Lant, Newcastle upon Tyne (GB); Nazarmohammad Gulamhussain Momin, Newcastle upon Tyne (GB); Antonio Quintieri, Waterloo (BE); Steven George Patterson, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 17 days.

(21) Appl. No.: 15/652,374

(22) Filed: Jul. 18, 2017

(65) Prior Publication Data

US 2018/0030390 A1 Feb. 1, 2018

(30) Foreign Application Priority Data

Jul. 28, 2016 (EP) ..... 16181801

(51) Int. Cl.

| | |
|---|---|
| ***C11D 11/00*** | (2006.01) |
| ***C11D 3/37*** | (2006.01) |
| ***C11D 3/386*** | (2006.01) |
| ***C11D 17/04*** | (2006.01) |
| ***C11D 3/382*** | (2006.01) |

(52) U.S. Cl.

CPC ..... *C11D 11/0094* (2013.01); *C11D 3/3715* (2013.01); *C11D 3/382* (2013.01); *C11D 3/38618* (2013.01); *C11D 3/38627* (2013.01); *C11D 3/38672* (2013.01); *C11D 17/045* (2013.01)

(58) Field of Classification Search

None

See application file for complete search history.

(56) References Cited

U.S. PATENT DOCUMENTS

| | | | | |
|---|---|---|---|---|
| 5,385,959 | A * | 1/1995 | Tsaur | C11D 3/38627 428/402.24 |
| 6,624,129 | B1 * | 9/2003 | Borch | C11D 1/83 435/196 |
| 2001/0000174 | A1 * | 4/2001 | Scepanski | C11D 3/386 510/392 |
| 2008/0221008 | A1 * | 9/2008 | Mikkelsen | C11D 3/386 510/393 |
| 2016/0122738 | A1 | 5/2016 | Babe et al. | |

FOREIGN PATENT DOCUMENTS

| | | | |
|---|---|---|---|
| EP | 2 771 458 | B1 | 9/2014 |
| WO | WO 1997/030172 | A1 | 8/1997 |
| WO | WO 2005/028603 | A1 | 3/2005 |
| WO | WO 2010/003934 | | 1/2010 |
| WO | WO 2014/099523 | A1 | 6/2014 |
| WO | WO 2014/107639 | A1 | 7/2014 |
| WO | WO 2014/164777 | A1 | 10/2014 |
| WO | WO 2015/038792 | A1 | 3/2015 |

OTHER PUBLICATIONS

EP Search Report for (Application No. 16181801.8-1375 dated Jan. 18, 2017.

* cited by examiner

*Primary Examiner* — Lorna M Douyon

(74) *Attorney, Agent, or Firm* — Gregory S. Darley-Emerson

(57) ABSTRACT

A process for reblending a first liquid detergent composition into a second liquid detergent composition.

15 Claims, No Drawings

PROCESS FOR REBLENDING A FIRST LIQUID DETERGENT COMPOSITION INTO A SECOND LIQUID DETERGENT COMPOSITION

FIELD OF THE INVENTION

The present disclosure relates to a process for reblending a first liquid detergent composition into a second liquid detergent composition.

BACKGROUND OF THE INVENTION

Enzymes are often used by formulators in liquid detergent compositions to provide various cleaning and/or care benefits. However, in some instances, other detergent ingredients can act as substrates for enzymes formulated into the detergent composition, which results in these ingredients being broken down by the enzymes. This can negatively affect the cleaning or care ability of the detergent composition which in turn negatively affects the cleaning experience by the consumer. Often this incompatibility is overcome by formulating enzymes and substrates into different compartments of a multi-compartmental product such as a multi-compartment water-soluble unit dose article.

Certain product or detergent made is not shipped to consumers for various reasons. In terms of cost and efficiency it is often preferred to reblend such product back into the manufacturing process. However, presence of enzymes either deliberately present in the product intended to be reblended or there as contamination (e.g. where a water-soluble unit dose rupturing process accidentally rupture two compartments rather than just one compartment) may negatively affect other ingredients in the composition to which the reblend composition is added.

Therefore, there is a need in the art for a process to denature enzymes in a first liquid detergent composition intended to be reblended into a second liquid detergent composition. It is further desired that the denaturing process is selective to enzyme denaturation and does not negatively affect the other ingredients present in the liquid detergent composition.

It was surprisingly found the process of the present disclosure overcame this technical problem.

SUMMARY OF THE INVENTION

The present disclosure relates to a process for reblending a first liquid detergent composition into a second liquid detergent composition comprising the steps of:

a. taking a first liquid detergent composition comprising an enzyme;
b. heating the first liquid detergent to a temperature between 50° C. and 90° C. for between 1 minute and 360 minutes,
c. optionally wherein the first liquid composition is cooled;
d. flowing the first liquid detergent composition into a second liquid detergent composition.

DETAILED DESCRIPTION OF THE INVENTION

The Process for Reblending

The present disclosure relates to a process for reblending a first liquid detergent composition into a second liquid detergent composition. The first and second liquid detergent compositions are described in more detail below.

The first liquid detergent composition and the second liquid detergent composition are independently selected from the group comprising fabric detergent compositions, automatic dishwashing compositions, hand dish compositions, hard surface cleaners or a mixture thereof. Preferably the first liquid detergent composition and the second liquid detergent composition are fabric detergent compositions.

The process may be continuous, batch or a combination thereof.

The process comprises the following steps;

a. taking a first liquid detergent composition comprising an enzyme.

The first liquid detergent composition and the enzyme are described in more detail below.

b. heating the first liquid detergent composition to a temperature between 50° C. and 90° C. for between 1 minute and 360 minutes.

The first liquid detergent composition is heated to between 50° C. and 90° C. for between 1 minute and 360 minutes. In other words, the first liquid detergent composition is kept at a temperature of between 50° C. and 90° C. for between 1 minute and 360 minutes. Therefore, only once the first liquid detergent composition is heated to a temperature of between 50° C. and 90° C. is it then kept at said temperature for between 1 minute and 360 minutes.

Preferably, the first liquid detergent is heated to between 60° C. and 85° C., preferably between 70° C. and 80° C. Alternatively, the first liquid detergent may be heated to between 55° C. and 70° C., preferably 50° C. to 65° C.

Preferably, the first liquid detergent is heated for between 1 minute and 180 minutes, preferably between 1 minute and 60 minutes, more preferably 1 minute and 45 minutes.

Alternatively, the first liquid is heated for between 60 minutes and 360 minutes, preferably between 70 minutes and 300 minutes, more preferably between 70 minutes and 200 minutes.

Alternatively, the first liquid is heated for between 1 minute and 360 minutes, preferably between 2 minutes and 180 minutes, more preferably between 5 minutes and 45 minutes, most preferably between 7 minutes and 35 minutes.

The first liquid detergent composition may be heated to between 60° C. and 85° C., preferably between 70° C. and 80° C. for between 1 minutes and 180 minutes, preferably between 1 minutes and 60 minutes, more preferably 1 minutes and 45 minutes.

The first liquid detergent composition may be heated to between 60° C. and 85° C., preferably between 70° C. and 80° C. for between 1 minute and 360 minutes, preferably between 2 minutes and 180 minutes, more preferably between 5 minutes and 45 minutes, most preferably between 7 minutes and 35 minutes.

The first liquid detergent composition may be heated to between 55° C. and 70° C., preferably 50° C. to 65° C. for between 60 minutes and 360 minutes, preferably between 70 minutes and 300 minutes, more preferably between 70 minutes and 200 minutes.

Table 1 discloses further examples of suitable temperatures to heat the first liquid detergent composition and time at which the first liquid detergent composition is kept at said temperature.

TABLE 1

| Example | Temp range (° C.) | Time Range (mm) |
|---|---|---|
| 1 | 85-90 | 1-5 |
| 2 | 80-90 | 1-10 |
| 3 | 75-80 | 1-25 |
| 4 | 70-80 | 1-30 |
| 5 | 60-70 | 5-180 |
| 6 | 55-77 | 10-300 |
| 7 | 50-65 | 60-360 |
| 8 | 50-60 | 60-360 |
| 9 | 60-65 | 100-300 |
| 10 | 70-75 | 10-60 |
| 11 | 72-78 | 10-60 |
| 12 | 73-83 | 1-30 |

Those skilled in the art will recognise any suitable means to heat the first liquid detergent composition to the appropriate temperature and for the appropriate time. Suitable means to heat the first liquid detergent composition include but are not limited to a heat exchanger device, microwave heater, infra-red heater or a mixture thereof. A heat exchanger is any device that transfers heat from one medium to another.

The heat exchanger may be selected from a plate and frame heat exchanger, shell and tube heat exchangers, and combinations thereof. Heat exchangers may be selected from tubular heat exchanger, shell and tube heat exchanger, plate heat exchangers, plate and shell heat exchangers, adiatbatic wheel heat exchanger, plate fin heat exchanger, pillow plate heat exchanger, fluid heat exchanger, waste recovery heat exchanger, dynamic scraped surface heat exchanger, phase-change heat exchanger, direct contact heat exchangers and mixtures thereof.

Other heating devices may include immersion heaters, flanged heaters, screw plug heaters, circulation heaters, over the side heaters, pipe heaters, tubular heaters, finned tubular heaters, cartridge heaters and mixtures thereof.

The first liquid detergent may be passed through more than one heat exchanger device. In this case the second and subsequent heat exchanger devices are typically arranged in series with respect to the first heat exchanger.

The first detergent liquid maybe heated inline, the first detergent liquid may be heated by transferring it to a holding tank and heating it whilst in the tank, or a mixture thereof.

Heating may be conducted inline as the first liquid detergent flows through a suitable heating device. In other words, the process is a continuous one in which the first liquid detergent composition is flowed continuously into the second liquid detergent composition and in which the first liquid detergent composition is heated inline as it flows. Alternatively, the first liquid detergent may be heated to the appropriate temperature and for the appropriate time in a holding tank. In other words, the first liquid detergent composition may be flowed/transferred into a holding/batch tank where it is heated accordingly, and then allowed to flow/transferred from the batch tank into the second liquid detergent composition.

c. optionally wherein the first liquid composition is cooled;

The first liquid detergent is preferably cooled before adding to the second liquid detergent. Preferably, the first liquid is cooled to between 15° C. and 45° C., more preferably to between 20° C. and 25° C.

The first liquid detergent may be cooled at a rate of between 1° C./min and 30° C./min, preferably between 2° C./min and 20° C./min, more preferably between 5° C./min and 10° C./min.

Alternatively, the first liquid detergent may be cooled to between 15° C. and 45° C., preferably to between 20° C. and 25° C. over a period of between 1 hour and 24 hours, preferably between 5 hours and 24 hours, more preferably between 10 hours and 24 hours.

Those skilled in the art will be aware of suitable means to cool the first liquid detergent composition. The first liquid detergent composition may be cooled using mechanical cooling means such as passing it through a heat exchanger device. Suitable heat exchanger devices can be selected from the group consisting of: plate and frame heat exchanger, shell and tube heat exchangers, and combinations thereof. The first liquid detergent may be passed through more than one heat exchanger device. In this case the second and subsequent heat exchanger devices are typically arranged in series with respect to the first heat exchanger.

Alternatively, the first liquid detergent composition may be cooled by simply storing the first liquid detergent composition in a suitable holding or batch tank until it reaches the appropriate temperature in the absence of any mechanical means to cool the first liquid detergent composition.

In order to ensure high throughput and/or a continuous manufacturing process it may be preferred to cool the first liquid detergent composition to between 15° C. and 45° C., more preferably to between 20° C. and 25° C. at a rate of between 1° C./min and 30° C./min, preferably between 2° C./min and 20° C./min, more preferably between 5° C./min and 10° C./min. Preferably this is achieved using a mechanical cooling means.

d. flowing the first liquid detergent composition into a second liquid detergent composition.

Those skilled in the art will know how to combine the first liquid detergent composition with the second liquid detergent composition.

The first liquid detergent composition and the second liquid detergent composition may be combined to form a third liquid detergent composition and wherein the first liquid detergent composition flows into the second liquid detergent composition at a rate such that the third liquid detergent composition is composed of the first liquid detergent composition and the second liquid detergent composition a ratio of 1:100 to 1:10.

The process may comprise a step wherein the first liquid composition, the second liquid composition or both, are obtained from one or more compartments of a multicompartment water-soluble unit dose article wherein the one or more compartments are ruptured in order to obtain said first liquid detergent composition, second liquid detergent composition or both.

The process may comprise in step a. rupturing one or more compartments of a multicompartment water-soluble unit dose article in order to obtain the first liquid detergent composition.

The process may comprise in step a. rupturing at least one compartment of a multicompartment water-soluble unit dose article in order to obtain the first liquid detergent composition and wherein at least one compartment of the multicompartment water-soluble unit dose article is not ruptured.

The multicompartment water-soluble unit dose article is described in more detail below.

First Liquid Detergent Composition

The first detergent composition is a liquid. The term 'liquid detergent composition' refers to any detergent composition comprising a liquid capable of wetting and treating an item or surface e.g., cleaning clothing in a domestic washing machine, and includes, but is not limited to, liquids, gels, pastes, dispersions and the like. The liquid composition can include solids or gases in suitably subdivided form, but the liquid composition excludes forms which are non-fluid overall, such as tablets or granules.

The first liquid detergent composition comprises between 0.0001% and 0.75%, preferably between 0.0005% and 0.5%, more preferably between 0.001% and 0.5% by weight of the first liquid detergent composition of the enzyme.

The enzyme in the first liquid detergent composition may be selected from the group comprising hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof, preferably wherein the enzyme is a lipase, a cellulase, a protease or a mixture thereof, most preferably wherein the enzyme is a lipase.

The enzyme may be encapsulated. By encapsulated, we herein mean that the enzyme is immobilized within a particle or the like and is not 'free' within the liquid detergent composition.

The encapsulated enzyme may be of the core-shell type, absorbed onto or into a matrix or a mixture thereof, preferably the encapsulated enzyme is of the core-shell type. A core-shell particle is one comprising an outer shell that surrounds a core, wherein the enzyme is comprised within the core.

When in encapsulated form the enzymes are typically encapsulated in a polymeric material. Methods of encapsulation of the enzymes are for example, by spray-drying a liquid composition containing the enzyme(s) and the polymer(s), or by drying a liquid composition containing the enzyme and polymer, or by emulsion polymerisation, coacervation, precipitation or interfacial polymerisation optionally in the presence of the enzyme, optionally followed by drying and/or size reduction processes. Suitable polymers for encapsulating enzymes include: polyvinyl alcohol, polyvinylpyrrolidone, carboxymethylcellulose, guar gum, polycarboxylic acid, methylcellulose, hydroxypropyl methylcellulose, proteins, polybranched polyamines, such as polyethyleneimines (PEI), (hydrophobically modified) polysaccharide modified cellulosic polymers, derivatives or co-polymers thereof and mixtures thereof. Examples of modified cellulosic polymers include hydroxypropyl methylcellulose phthalate, cellulose acetate phthalate Examples of modified gums include modified guar gum, gum benzoin, gum tragacanth, gum arabic and gum acacia. Examples of modified proteins are modified casein, gelatin and albumin. Examples of modified polymers may be selected from copolymers of at least one hydrophobic vinylic monomer with a least one hydrophilic vinylic monomer. Suitable hydrophilic vinylic monomer is vinylpyrrolidone. Suitable hydrophobic vinylic monomer is C1-C18 alkyl acrylates, C1-C18 alkyl methacrylates, C3-C18 cycloalkyl acrylates, C3-C18 cycloalkyl methacrylates and vinyl C1-C18 alkanoates and mixtures thereof. The polymer may comprise a polymer selected from homo- and copolymers having a C—C-backbone, wherein the C—C-backbone carries carboxyl groups, which may be present in the acidic form or in the neutralized form, and wherein the C—C—backbone comprises at least 20% by weight, e.g. from 20 to 98% by weight, based on the total weight of the polymer (i.e. based on the total weight of repeating units in the polymer P), of hydrophobic repeating units. The polymer may comprise branching, for example branched copolymer matrix particles formed from vinyl pyrrolidone and vinyl acetate. The polymer may comprise a copolymers, for example as described in WO2010/003934, based on maleic acid or (meth) acrylic acid. The polymer may be cross-linked.

Preferred polymers have a molecular weight from 1000 to 500,000, or 2000 to 200000 Dalton weight average. Typically the weight ratio of enzyme to polymer is from 1:50 to 10:1.

The polymer may be selected to be substantially soluble in an aqueous solution having an ionic strength of 0 mol/kg and insoluble in an aqueous solution having an ionic strength of more than 1 mol/kg, for example in which the polymer comprises 35-95% w/w of hydrophilic monomer units, based on the total weight of the polymer.

Hydrophobic ally modified polyvinyl alcohol or hydrophobic ally modified polyvinyl pyrrolidone may be preferred, optionally with high levels of hydrolysis, greater than 60%, or even greater than 80 or 90%. Suitable hydrophobic modifying groups include keto-ester and/or butyryl groups and mixtures thereof and preferably the total degree of substitution (DS) is between about 3% and 20%.

The enzyme, when present in an additive particle may be the only enzyme in the additive particle or may be present in the additive particle in combination with one or more additional enzymes.

Preferably, the shell material comprises a polymeric material, preferably selected from polyvinyl alcohol, polyvinylpyrrolidone, carboxymethylcellulose, guar gum, polycarboxylic acid, methylcellulose, hydroxypropyl methylcellulose, proteins, polybranched polyamines, such as polyethyleneimines (PEI), (hydrophobically modified) polysaccharide modified cellulosic polymers, derivatives or co-polymers thereof and mixtures thereof.

The first liquid composition may comprise a heat sensitive ingredient, preferably wherein the heat sensitive ingredient is selected from perfume, a dye, a surfactant, a polymer or a mixture thereof, more preferably selected from perfume, a dye, a surfactant or a mixture thereof.

Those skilled in the art will be aware of suitable perfume materials.

Those skilled in the art will be aware of suitable dyes. Dyes include shading or non-shading dyes. Preferably, the dye comprises a non-shading dye. Preferred non-shading dyes are sold under the tradename Liquitint by Milliken.

Those skilled in the art will be aware of suitable surfactants. The surfactant may be selected from anionic surfactants, non-ionic surfactants, amphoteric surfactants, zwitterionic surfactants, cationic surfactants or a mixture thereof. Preferably the surfactant is selected from anionic surfactants, non-ionic surfactants or a mixture thereof.

Preferably, the anionic surfactant is selected from linear alkylbenzene sulphonate, alkoxylated alkyl sulfate, or a mixture thereof.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Especially useful are the sodium, potassium and amine linear straight chain alkylbenzene sulfonates in which the average number of carbon atoms in the alkyl group is from about 11 to 14.

Specific, non-limiting examples of anionic surfactants useful herein include the acid or salt forms of: a) $C_{11}$-$C_{18}$ alkyl benzene sulfonates (LAS); b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates with non-limiting examples of suitable cations including sodium, potassium, ammonium, amine and mixtures thereof; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates; g) mid-chain branched alkyl alkoxy sulfates; h) modified alkylbenzene sulfonate; i) methyl ester sulfonate (MES); and j) alpha-olefin sulfonate (AOS).

Preferably, the non-ionic surfactant is selected from fatty alcohol alkoxylate, an oxo-synthesised fatty alcohol alkoxylate, Guerbet alcohol alkoxylates, alkyl phenol alcohol alkoxylates or a mixture thereof.

The nonionic surfactant may comprise an ethoxylated nonionic surfactant. The ethoxylated nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

The ethoxylated alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $RO(EO)_nH$, wherein R represents an alkyl chain between 4 and 30 carbon atoms, (EO) represents one unit of ethylene oxide monomer and n has an average value between 0.5 and 20.

Those skilled in the art will be aware of suitable polymers.

The first liquid detergent composition may comprise between 0.1% and 20%, preferably between 0.5% and 15%, most preferably between 1% and 13% by weight of the first liquid detergent composition of water.

Second Liquid Detergent Composition

The second liquid detergent composition is a liquid. The term 'liquid detergent composition' refers to any detergent composition comprising a liquid capable of wetting and treating an item or surface e.g., cleaning clothing in a domestic washing machine, and includes, but is not limited to, liquids, gels, pastes, dispersions and the like. The liquid composition can include solids or gases in suitably subdivided form, but the liquid composition excludes forms which are non-fluid overall, such as tablets or granules.

The second liquid detergent composition may comprise less than 0.75%, preferably less than 0.5%, more preferably less than 0.0005%, most preferably less than 0.0001% by weight of lipase, cellulase, protease or a mixture thereof, more preferably lipase.

The second liquid detergent composition may comprise an ingredient that may act as a substrate for the enzyme, preferably wherein the substrate is selected from hydrogenated castor oil, perfume esters, polyester terephthalate polymer or a mixture thereof.

Hydrogenated castor oil (HCO) as used herein most generally can be any hydrogenated castor oil or derivative thereof, provided that it is capable of crystallizing in the liquid laundry detergent composition. Castor oils may include glycerides, especially triglycerides, comprising $C_{10}$ to $C_{22}$ alkyl or alkenyl moieties which incorporate a hydroxyl group. Hydrogenation of castor oil, to make HCO, converts the double bonds which may be present in the starting oil as ricinoleyl moieties. As such, the ricinoleyl moieties are converted into saturated hydroxyalkyl moieties, e.g., hydroxystearyl. The HCO herein may be selected from: trihydroxystearin; dihydroxystearin; and mixtures thereof. The HCO may be processed in any suitable starting form, including, but not limited to those selected from solid, molten and mixtures thereof. The corresponding percentage of hydrogenated castor oil delivered into a finished laundry detergent product may be below 1.0%, typically from 0.1% to 0.8%. HCO may be present at a level of between 0.01% and 1%, or even between 0.05% and 0.8% by weight of the liquid laundry detergent composition.

HCO of use in the present invention includes those that are commercially available.

Perfume esters are perfume raw materials wherein the perfume raw material comprises an ester. Those skilled in the art will be aware of suitable materials.

The polymer comprises a polyester terephthalate backbone grafted with one or more anionic or non-ionic groups. Suitable polymers have a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC—sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are sold by Clariant under the TexCare® series of polymers, e.g. TexCare® SRN240 and TexCare® SRA300. Other suitable soil release polymers are sold by Solvay under the Repel-o-Tex® series of polymers, e.g. Repel-o-Tex® SF2 and Repel-o-Tex® Crystal.

Water-Soluble Unit Dose Article

The process may comprise rupturing at least one compartment of a multicompartment water-soluble unit dose article to obtain the first liquid laundry detergent composition comprised within said at least one compartment. The water-soluble unit dose article comprises at least one water-soluble film shaped such that the unit-dose article comprises at least two internal compartment surrounded by the water-soluble film. At least one compartment comprises the first liquid laundry detergent composition. The water-soluble film is sealed such that the first liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the first liquid laundry detergent. Preferably, the unit dose article comprises a water-soluble film. The unit dose article is manufactured such that the water-soluble film completely surrounds the first liquid laundry detergent composition and in doing so defines the compartment in which the first liquid laundry detergent resides. The unit dose article may comprise two films. A first film may be shaped to comprise an open compartment into which the first liquid laundry detergent is added. A second film is then laid over the first film in such an orientation as to close the opening of the compartment. The first and second films are then sealed together along a seal region. The water-soluble film is described in more detail below.

The unit dose article may comprise more than two compartments, even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

One of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the first liquid laundry detergent according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the liquid laundry detergent composition is comprised in at least one of the compartments.

The film of the present invention is soluble or dispersible in water.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Use

A further aspect of the present invention is the use of a heating step to selectively denature an enzyme in a first liquid detergent composition in order to reblend the first liquid detergent composition into a second liquid detergent composition.

The heating step is as described above according to the present invention.

The first liquid detergent composition is as described above according to the present invention.

The second liquid detergent composition is as described above according to the present invention.

Method of making the first liquid detergent composition and the second liquid detergent composition Those skilled in the art will be aware of standard techniques and methods to make the first liquid detergent composition and the second liquid detergent composition.

EXAMPLES

Burnt beef stain swatches were prepared using 5 cm×5 cm knitted cotton (Warwick Equest), 200 μL of burnt beef fat (Warwick Equest) was dosed onto each 5×5 cm swatch and stored at 25° C. for 3 days prior to use. Rice starch and Chocolate soy milk stains (CFT, Netherlands) were also used as stains in this test.

Each test was repeated 4 times.

L*, a* b* values were obtained for burnt beef, rice starch and chocolate soy milk stains before the wash on a Digieye apparatus (commercially available from Verivide).

50 g of a liquid detergent comprising no enzyme was weighed out. The liquid detergent composition was the same as used in commercially available Ariel Pods products (available on Market in 2016) comprising no enzyme. To this 173.5 μL of Lipex evity, activity 28.8 mg/ml, supplied from Novozymes along, 483.8 μL of Savinase, activity 51.69 mg/ml, (Novozymes) or 159.8 μL of Termamyl Ultra, activity 21.9 mg/ml, (Novozymes) was added and allowed to mix for 30 minutes.

10 g of this stock formula was removed, giving treatment B. The remaining 40 g of this formula heated to 70° C. for 2½ hours stirring gently. Once the formula was heated 10 g of the formula was removed and the remaining 30 g was labelled treatment C. To this 10 g of formula 34.7 μL Lipex Evity, 96.7 μL Savinase or 31.9 μL Termamyl Ultra was added to give treatment D.

The relevant treatment was diluted 2 g/L in a 1 L pot and allowed to mix for 2 minutes. To this 55 g clean knitted cotton ballast (Warwick Equest) was added along with 2× burnt beef stains, 2× rice starch stains, 2× chocolate soy milk stains and 12× SBL2004 swatches (CFT).

Once the cycle was complete the stains were air dried overnight before L*, a* and b* values were obtained on the Digieye.

The soil release index (SRI) was then calculated as the different in L*, a* and b* values between the stained fabrics and the fabrics after washing.

Wash conditions used were;

Washing machine: Tergotometer

Detergent dose: 2 g/L

Cycle: 25 min wash 30° C./1×5 min rinse 15° C.

Water hardness: City water 7.6 gpg

Results can be seen Table 1 below;

| | | Soil Release Index | | | |
|---|---|---|---|---|---|
| Enzyme | Stain | Treatment A | Treatment B | Treatment C | Treatment D |
| Lipase | Burnt Beef | 72.34 | 75.55 | 69.65 | 74.6 |
| Protease | Choc Soy | 0 | 19.93 | 3.12 | 24.65 |
| Amylase | Rice Starch | 34.52 | 67.46 | 47.24 | 67.83 |

The data shows that Treatment B, which is Treatment A comprising enzyme, soil release index increases, in other words the stain removal capacity in increased.

Treatment C, is treatment B which has been heated to denature the enzyme according to the process of the present invention. In this case, the soil release index drops to a comparable level to that of treatment A indicating the enzyme has successfully been denatured.

Treatment D is treatment C wherein fresh enzyme has been added again at the same level as for treatment B. As can be seen the soil release index returns to a comparable level as for treatment B. This indicates that upon heating to create treatment C according to the precess of the present invention, only the enzyme was denatured and no other components of the detergent composition were affected.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for reblending a first liquid detergent composition into a second liquid detergent composition comprising the steps of:

a. taking a first liquid detergent composition comprising between about 0.0001% and about 0.75%, by weight of the first liquid detergent composition, of an enzyme;

b. heating the first liquid detergent composition to a temperature between about 50° C. and about 90° C. for between about 1 minute and about 360 minutes, c. optionally, cooling the first liquid detergent composition;

d. flowing the first liquid detergent composition into a second liquid detergent composition, wherein the second liquid detergent composition comprises an ingredient that may act as a substrate for the enzyme, wherein the substrate is selected from hydrogenated castor oil, perfume esters, polyester terephthalate polymer, or a mixture thereof; wherein the first liquid detergent composition and the second liquid detergent composition combine to form a third liquid detergent composition and wherein the first liquid detergent composition flows into the second liquid detergent composition at a rate such that the third liquid detergent composition is composed of the first liquid detergent composition and the second liquid detergent composition in a ratio of about 1:100 to about 1:10.

2. The process according to claim 1, wherein the first liquid detergent composition is heated to between about 60° C. and about 85° C.

3. The process according to claim 1, wherein the first liquid detergent composition is heated for between about 1 minute and about 180 minutes.

4. The process according to claim 1, wherein in step c the first liquid detergent composition is cooled to between about 15° C. and about 45° C.

5. The process according to claim 4, wherein the first liquid detergent composition is cooled at a rate of between about 1° C./min and about 30° C./min.

6. The process according to claim 4, wherein the first liquid detergent composition is cooled to between about 15° C. and about 45° C., over a period of between about 1 hour and about 24 hours.

7. The process according to claim 1, wherein the enzyme in the first liquid detergent composition is selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, mixtures thereof.

8. The process according to claim 1, wherein the second liquid detergent composition comprises less than 0.75%, by weight, of lipase, cellulase, protease, or a mixture thereof.

9. The process according to claim 8, wherein the second liquid detergent composition comprises less than 0.75%, by weight, of lipase.

10. The process according to claim 1, wherein the first liquid detergent composition is heated inline, the first liquid detergent composition is heated by transferring it to a holding tank and heating it whilst in the tank, or a mixture thereof.

11. The process according to claim 1, wherein the enzyme is encapsulated.

12. The process according to claim 1, wherein the first liquid detergent composition further comprises a heat sensitive ingredient.

13. The process according to claim 1, wherein the first liquid detergent composition and the second liquid detergent composition are independently selected from the group consisting of fabric detergent compositions, automatic dishwashing compositions, hand dish compositions, hard surface cleaners, and a mixture thereof.

14. The process according to claim 1, wherein the process is continuous, batch, or a combination thereof.

15. The process according to claim 1, wherein the first liquid detergent composition, the second liquid detergent composition or both, are obtained from one or more compartments of a multicompartment water-soluble unit dose article wherein the one or more compartments are ruptured in order to obtain said first liquid detergent composition, second liquid detergent composition or both.

* * * * *